US006230589B1

(12) United States Patent
Junkers

(10) Patent No.: US 6,230,589 B1
(45) **Date of Patent: *May 15, 2001**

(54) POWER TOOL

(76) Inventor: John K. Junkers, 7 Arrowhead La., Saddle River, NJ (US) 07540

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/106,591

(22) Filed: Jun. 29, 1998

(51) Int. Cl.[7] ..... B25B 13/46
(52) U.S. Cl. ..... 81/57.39
(58) Field of Search ..... 81/57.39, 57.38; 254/29 A

(56) References Cited

U.S. PATENT DOCUMENTS

| | | | | |
|---|---|---|---|---|
| 4,047,456 | * | 9/1977 | Schotz | 81/57.38 |
| 4,104,934 | * | 8/1978 | Raschke et al. | 81/57.38 |
| 5,499,558 | * | 3/1996 | Junkers | 81/57.39 |
| 5,539,970 | * | 7/1996 | Junkers | 81/57.38 X |

FOREIGN PATENT DOCUMENTS 0 708 259 4/1996 (EP) .

* cited by examiner

*Primary Examiner*—D. S. Meislin
(74) *Attorney, Agent, or Firm*—Michael J. Striker

(57) ABSTRACT

A power tool has a tool part having an axis and including interreacting driving and housing portions so that during an operation of the power tool the driving portion has a tendency to turn in one direction at a given force while the housing portion has a tendency to turn in an opposite direction at a same given force, a sleeve part with a first outer sleeve and a second inner sleeve connected with one another by a thread and with a friction ring axially moveably connected to the inner sleeve, so that when the outer sleeve is turned on the friction ring, the inner sleeve moves axially and displaces axially a threaded connector engageable by the inner sleeve, a first connecting element which connects the driving portion with the outer sleeve, and a second connecting element which connect the housing portion with the inner sleeve, the connecting elements being formed so that during the operation of the power tool, the inner sleeve axially displaces relative to at least one of the interreacting tool portions.

5 Claims, 5 Drawing Sheets

POWER TOOL

BACKGROUND OF THE INVENTION

The present invention relates to power tools, and in particular to fluid operated power tools for elongating and relaxing threaded connectors.

The power tools of the above mentioned general type are known in the art. One of such power tools is disclosed in my U.S. Pat. No. 5,499,558. The power tool disclosed in this patent has tool means with two interreacting tool portions including a driving portion and a housing portion, and sleeve means including a first outer sleeve, a second inner sleeve connected by a thread with said outer sleeve, and a friction ring. The tool portions cooperate with the sleeves, so that the outer sleeve is turned and as a result the inner sleeve is moved axially and displaces a threaded connector engaged by the inner sleeve to elongate or to relax the threaded connector. The above described power tool can be further modified.

SUMMARY OF THE INVENTION

Accordingly, it is an object of present invention to provide a power tool of the above mentioned general type, which is a further modification of existing power tools.

In keeping with these objects and with others which will become apparent hereinafter, one feature of present invention resides, briefly stated, in a power tool which has an axis and includes two interreacting tool portions which are coaxial with the axis, the interreacting tool portions include a driving portion and a housing portion arranged so that during an operation of the power tool the driving portion has a tendency to turn in one direction at a given force while the housing portion has a tendency to turn in an opposite direction at a same given force; sleeve means including a first outer sleeve and a second inner sleeve connected with one another by a thread so that the outer sleeve is turnable relative to the inner sleeve around the axis; and a friction ring axially moveably connected to the inner sleeve; and connecting means including first connecting means which connect the driving portion with the outer sleeve, and second connecting means which connect the housing portion with the inner sleeve, the connecting means being formed so that during the operation of the power tool, the inner sleeve axially displaces relative to at least one of the interreacting tool portions which are coaxial with said axis, the interacting tool portions including a driving portion and a housing portion arranged so that during an operation of the power tool the driving portion turns in one direction at a given force while the housing portion turns in an opposite direction at a same given force, sleeve means including a first outer sleeve and a second inner sleeve connected with one another by a thread so that the outer sleeve is turnable relative to the inner sleeve around the axis, a friction ring axially moveably connected to the inner sleeve, so that when the outer sleeve is turned on said friction ring, the inner sleeve moves axially and displaces axially a threaded connector engageable by the inner sleeve, first connecting means for connecting the driving portion with the outer sleeve, and second connecting means for connecting the housing portion with the inner sleeve, the connecting means being formed so that during the operation of the power tool, the inner sleeve axially displaces relative to at least one of the interacting tool portions, and a ring-shaped member which is separate from and connected with the driving portion and which is also connected with the first connecting means.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
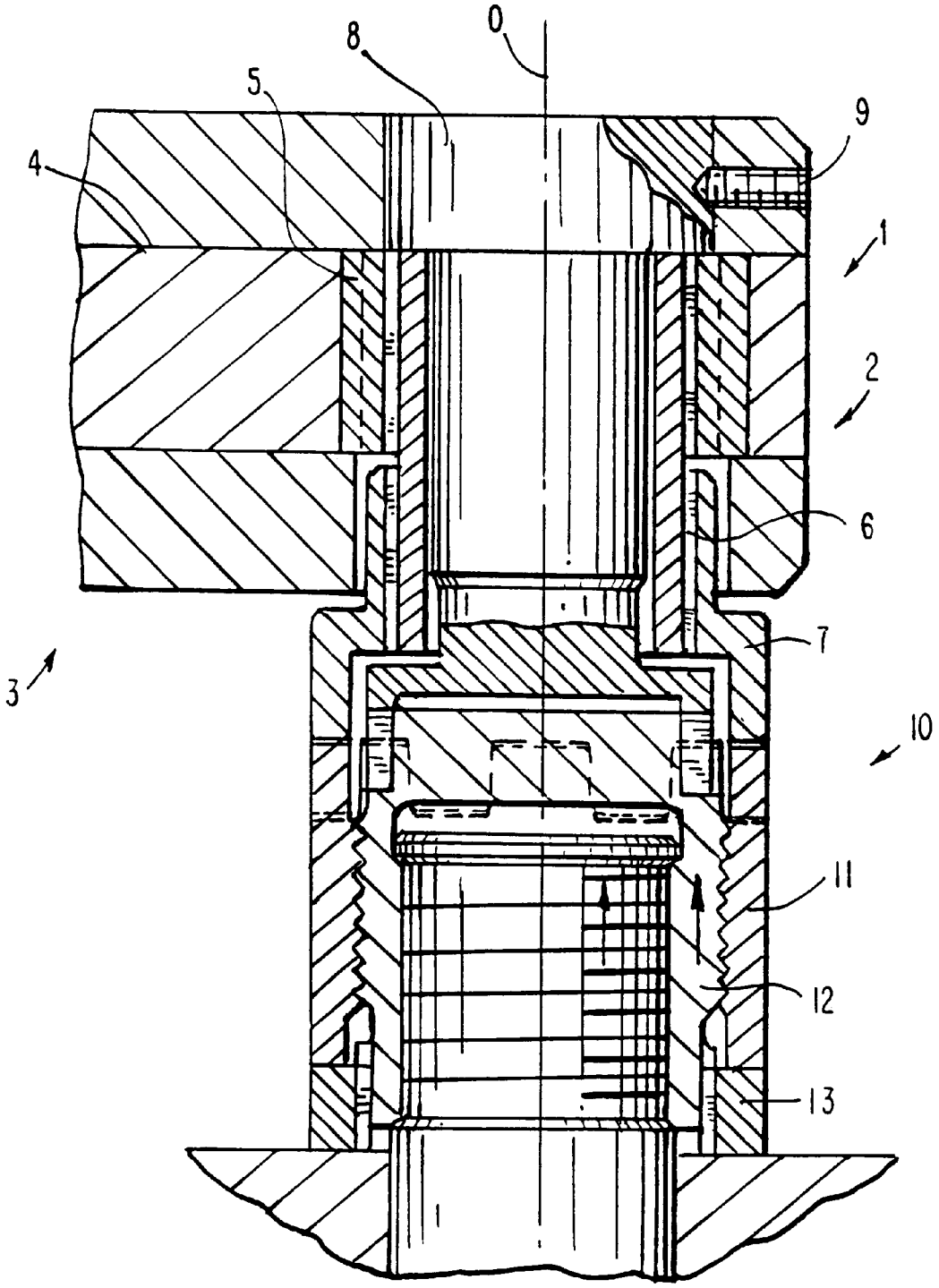
FIG. 1 is a view showing a power tool in accordance with one embodiment of the present invention.

A power tool in accordance with the present invention has a tool part which is identified as a whole with reference numeral 1 and include two interacting portions, namely a driving portion 2 and a housing portion 3. The driving portion 2 includes a drive plate 4 which is connected with a drive D of the power tool formed for example as a fluid-operated cylinder-piston unit and a ratchet 5 which is located inside the drive plate 4 and forms a part of a known ratchet-pawl mechanism with a pawl P. In response to a turning of the drive plate 4, a not shown pawl arranged on the drive plate turns the ratchet 5 around a central axis O, as disclosed for example in my earlier patent no. 5,499,588 which is incorporated by reference. The driving portion further includes a ring 6 which has an outer surface engaging an inner surface of the ratchet 5 on the one hand and also engaging an inner surface of a socket 7 on the other hand. The above mentioned engagements can be formed as interengaging splines provided on the corresponding surfaces.

The reaction shaft 8 extends inside the ring 6 with a gap therebetween for axial displacement along the axis 0. The reaction shaft 8 is connected with the housing 3, for example by a screw 9 so as to be fixed with one another.

The power tool further has a sleeve part which is identified as a whole with reference numeral 10. The sleeve part has an outer sleeve 11 provided with an inner thread, an inner sleeve 12 provided with an outer thread which engages with the inner thread of the outer sleeve 11, and a friction ring 13 which has an upper surface for free abutment of the outer sleeve 11 and an inner surface engaging a portion of the outer surface of the inner sleeve and axially movable to the inner sleeve, for example through splines.

The socket 7 forms first connecting means for connecting the driving portion 2 with the outer sleeve 11. For this purpose the socket 7 at its lower end is provided with castellations engaging in corresponding castellations of the upper surface of the outer sleeve 11. The reaction shaft 8 and in particular its lower part end forms second connecting means for connecting the housing portion 3 with the inner sleeve 12. For this purpose the lower end of the reaction shaft 8 has castellations cooperating with upper castellations of the inner sleeve 12. As can be seen from the drawings, the first connecting means 7 is movable in direction of the axis 0 along the ring 6, while the second connecting means 8 is immovable axially.

The power tool in accordance with the present invention operates in the following manner:

When the drive plate 4 is turned by a not shown drive, it turns the ratchet 5 around the axis 0, and the ratchet through the ring 6 and the socket 7 turns the outer ring 11 around the same axis. In response to the turning of the outer sleeve 11, the inner sleeve 12 connected with the outer sleeve 11 by the thread is displaced axially upwardly, so that the reaction shaft 8 and the housing 3 connected with it are also moved axially, and a threaded connector engaged by the inner sleeve 12 is tightened or loosened.

Figure 2:
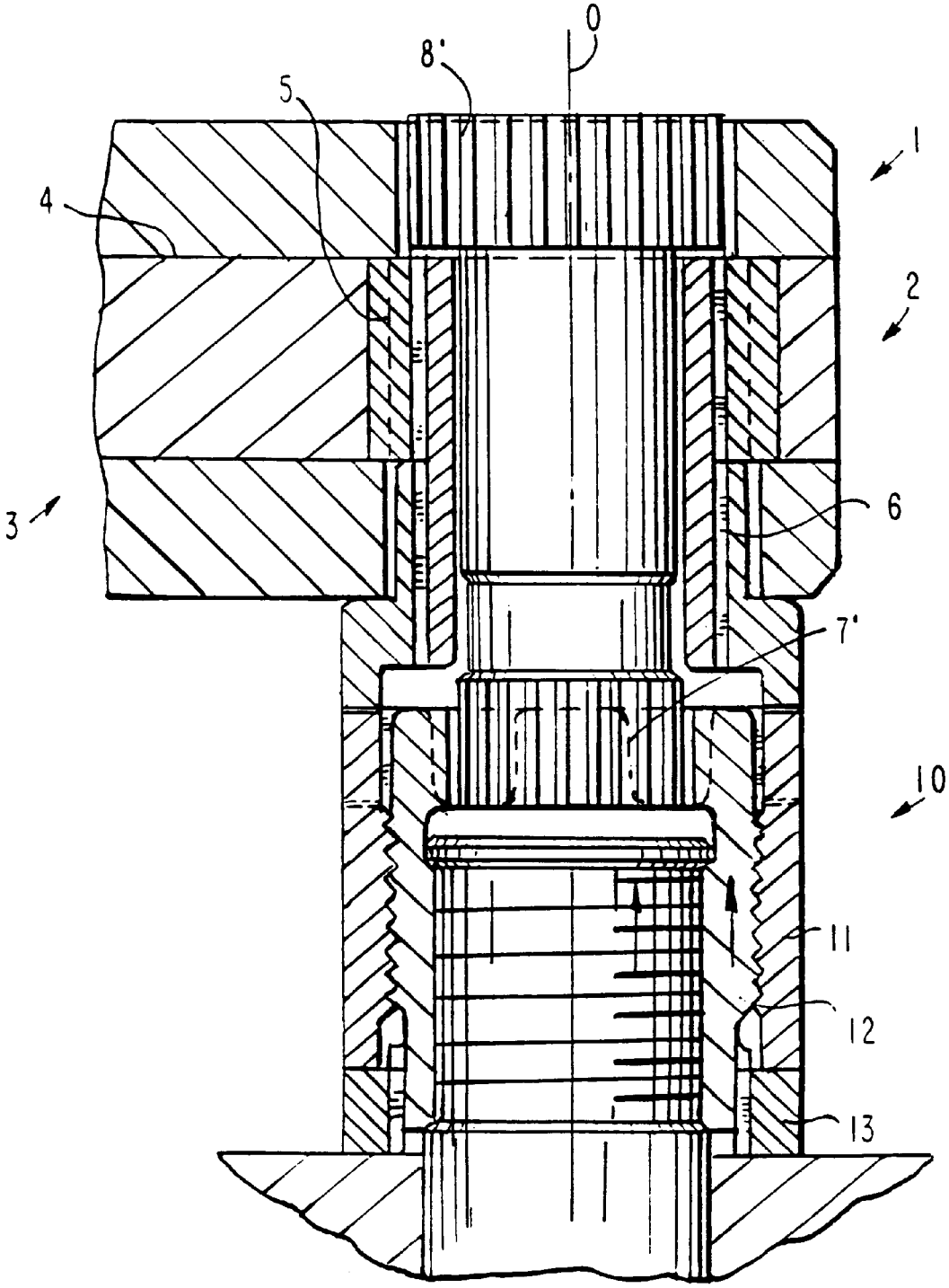
FIG. 2 is a view showing a power tool in accordance with another embodiment of the present invention.

The power tool of the embodiment of FIG. 2 substantially corresponds to the power tool of the embodiment of FIG. 1. The first connecting means is also formed by the socket 7. However, the power tool shown in FIG. 2 is different in that the reaction shaft and the second connecting means are formed differently. The reaction shaft 8' is not connected fixedly with the housing 3, but instead is freely axially movable relative to the housing 3, for example by a spline connection between the upper part of the reaction shaft 8' and the upper part of the housing 3. The second connecting means which is formed by the lower end of the reaction shaft and connect the housing 3 with the inner sleeve 12, in contrast to the embodiment of FIG. 1 is formed movably along the axis O, in particular by providing the lower end of the reaction shaft 8' with axially extending splines cooperating with the splines on the inner surface of the inner sleeve 12.

During the operation of the power tool shown in FIG. 2 when the outer sleeve 11 is turned by the driving portion 2 through the first connecting means 7, the inner sleeve 12 also moves axially, but the housing 3 remains axially stationary.

Figure 3:
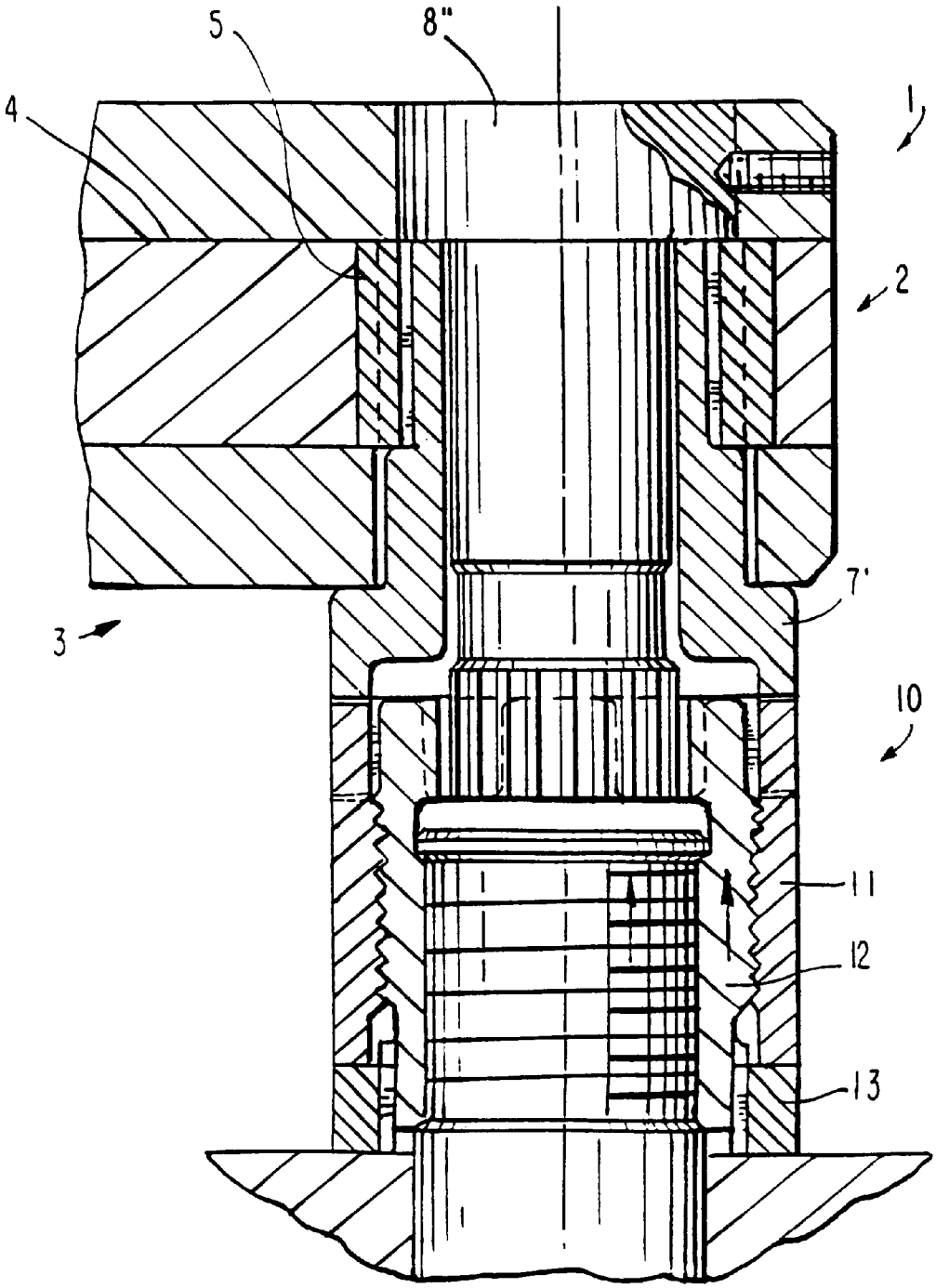
FIG. 3 is a view showing a power tool in accordance with still a further embodiment of the present invention.
Figure 4:
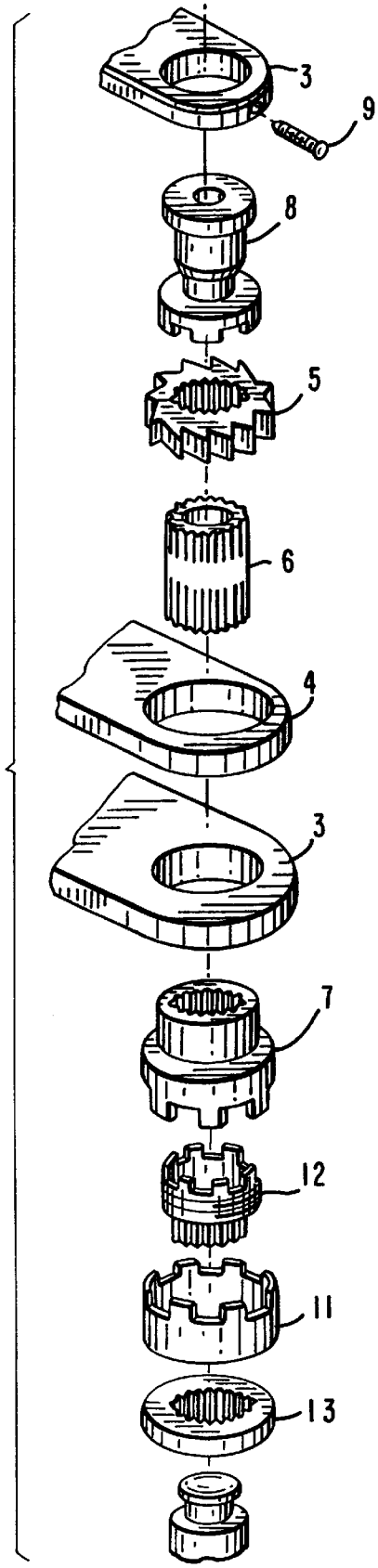
FIG. 4 is an exploded view of the power tool of the embodiment of FIG. 1.
Figure 5:
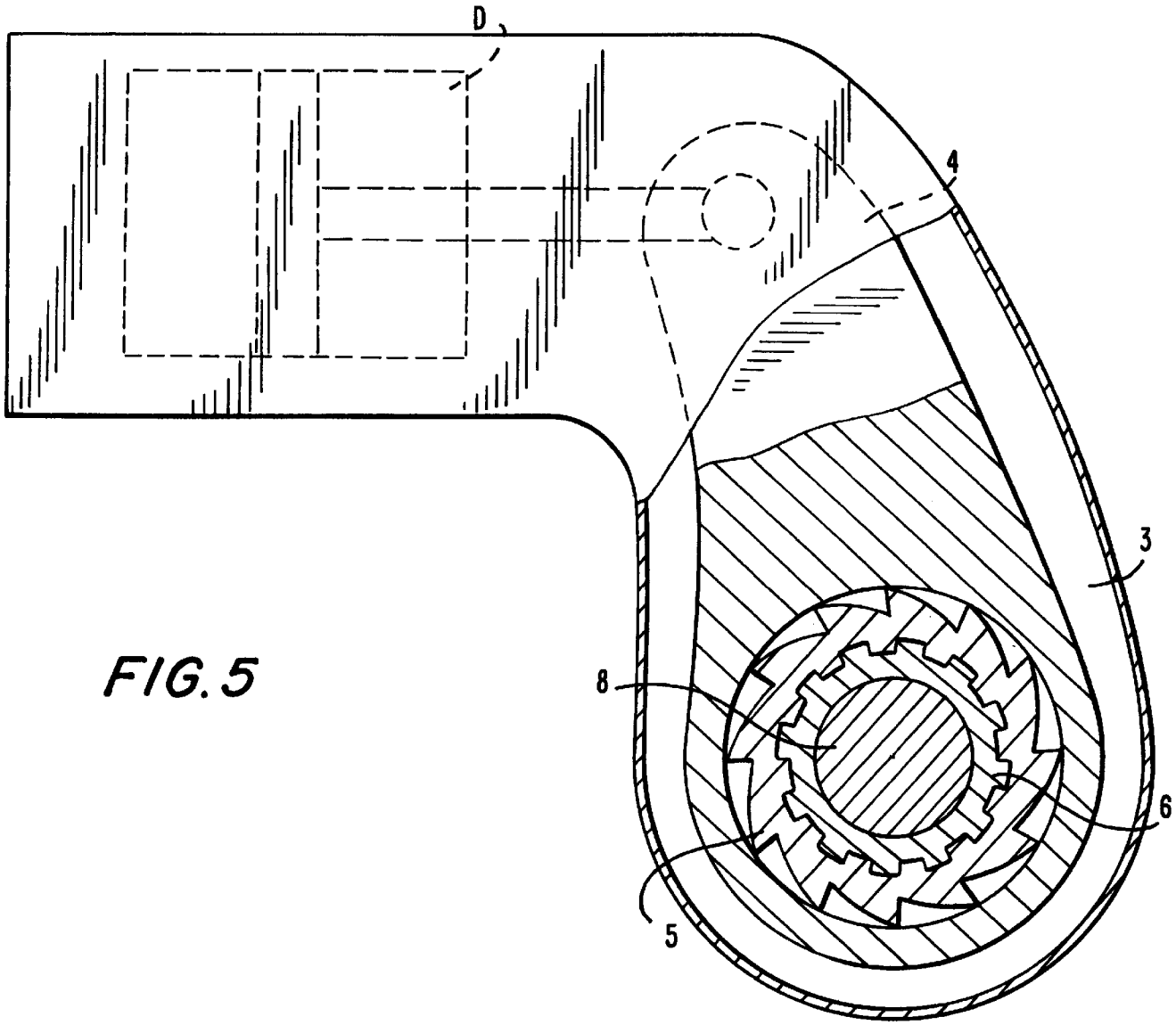
FIG. 5 is a view showing a cross-section of the power tool of the embodiment of FIG. 1, with further details.

The power tool of FIG. 3 substantially corresponds to the power tool of FIG. 1, but is different from it in the construction of the first and second connecting means. While in the embodiment of FIG. 1, the first connecting means or the sleeves 7 which connect the driving portion 2 with the outer sleeve 11 is movable along the axis A, in contrast the first connecting means or the sleeve 7' which connects the driving portion 2 with the outer sleeve 11 of the third embodiment shown in FIG. 3 is immovable along the axis O. Also, it is formed of one piece with the ring 6'. While in the embodiment of FIG. 1, the second connecting means or the lower end of the reaction shaft 8 which connect the housing portion 3 with the inner sleeve 11 is immovable axially, in contrast in the embodiment of FIG. 3 the second connecting means which is the lower end of the reaction shaft 8" is movable along the axis 0 due to interengaging splines provided on the outer surface of the lower end of the reaction shaft 8" and on the inner surface of the inner sleeve 12.

When during the operation of the power tool shown in FIG. 3 the outer sleeve 11 is turned by the driving portion 2, the inner sleeve 12 is moved axially upwardly relative to the outer sleeve 11, relative to the friction ring 13, and relative to the second connecting means or the lower end of the reaction shaft 8"At the same time, the housing 3 together with reaction shaft remains axially stationary.

It will be understood that each of the elements described above, or two or more together, may also find a useful application in other types of constructions differing from the types described above.

While the invention has been illustrated and described as embodied in power tool, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A power tool, comprising a tool part having an axis and including two interacting tool portions which are coaxial with said axis, said interacting tool portions including a driving portion turnable in one direction at a given force and a housing portion turnable in an opposite direction at a same given force; a sleeve part including an inner sleeve and an outer sleeve connected with said inner sleeve by a thread and turnable relative to said inner sleeve around said axis; a friction ring axially immovably connected with said inner sleeve, said outer sleeve being turnable on said friction ring and thereby said inner sleeve connected by said thread with said outer sleeve being movable axially and displacing axially a threaded connector engageable by said inner sleeve; a first connecting element for connecting said driving portion with said outer sleeve and transmitting the given force from said driving portion to said outer sleeve, and a second connecting element for connecting said housing portion with said inner sleeve and transmitting the given force from said housing portion to the inner sleeve to provide said axial displacement of said inner sleeve relative to at least one of said interacting tool portions; and a ring-shaped member which is separate from said driving portion of said tool part and said outer sleeve of said sleeve part and is located between said driving portion of said tool part and said outer sleeve of said sleeve part, said ring-shaped member being connected with said driving portion of said tool part and also connected with said first connecting element so as to transmit the driving force from said driving portion of said tool part to said first connecting element and thereafter to said outer sleeve of said sleeve part.

2. A power tool as defined in claim 1, wherein said connecting means during the operation of the power tool provide turning only of said outer sleeve while said inner sleeve and said housing portion move axially relative to said outer sleeve and relative to said friction ring.

3. A power tool as defined in claim 1, wherein said connecting means during the operation of tie power tool provide turning only of said outer sleeve while said inner sleeve moves axially relative to said outer sleeve and relative to said friction ring and said housing portion remains axially stationary.

4. A power tool as defined in claim 1, wherein said connecting means during the operation of the power tool provide turning only of said outer sleeve, while said inner sleeve moves axially relative to said outer sleeve, relative to said friction means, and relative to said second connecting means so that said housing portion remains axially stationary.

5. A power tool as defined in claim 1, wherein said driving portion of said tool part has engaging means, said first connecting element being connected with said outer sleeve of said sleeve means and having engaging means, said ring-shaped member having one engaging means which is engageable with said engaging means of said driving portion of said tool part and also having another engaging means which is engageable with said engaging means of said first connecting element of said outer sleeve of said sleeve part.

* * * * *